US007493717B2

(12) United States Patent
Gussalli Beretta

(10) Patent No.: US 7,493,717 B2
(45) Date of Patent: Feb. 24, 2009

(54) RECOIL DAMPER SYSTEM

(75) Inventor: Ugo Gussalli Beretta, Gardone Val Trompia (IT)

(73) Assignee: Fabbrica D'Armi Pietro Beretta S.p.A., Brescia (IT)

( * ) Notice: Subject to any disclaimer, the term of this patent is extended or adjusted under 35 U.S.C. 154(b) by 265 days.

(21) Appl. No.: 11/032,751

(22) Filed: Jan. 11, 2005

(65) Prior Publication Data

US 2006/0096148 A1 May 11, 2006

(30) Foreign Application Priority Data

Nov. 10, 2004 (IT) ..... MI2004A2155

(51) Int. Cl.
*F41C 23/00* (2006.01)

(52) U.S. Cl. ..... 42/74

(58) Field of Classification Search ..... 42/74
See application file for complete search history.

(56) References Cited

U.S. PATENT DOCUMENTS 2,731,753 A * 1/1956 Mathieu ..... 42/74
2,754,608 A * 7/1956 Stieffel, Jr. ..... 42/74
3,209,482 A * 10/1965 Kuzma et al. ..... 42/74
3,707,797 A * 1/1973 Ruth ..... 42/74
3,754,344 A * 8/1973 Spiliotis ..... 42/74
4,439,943 A * 4/1984 Brakhage ..... 42/74
5,031,348 A * 7/1991 Carey ..... 42/74
5,392,553 A * 2/1995 Carey ..... 42/73
2002/0053156 A1* 5/2002 McCarthy ..... 42/74
2003/0154640 A1* 8/2003 Bragg ..... 42/74

* cited by examiner

*Primary Examiner*—Troy Chambers
(74) *Attorney, Agent, or Firm*—James V. Costigan; Hedman & Costigan, P.C.

(57) ABSTRACT

A recoil damper system (10) suitable for transmitting a dampened and reduced recoil to the user, comprising an insert (20) designed to be housed inside the stock (11) of a rifle (12), and intended to house damping means (40), a mobile interface (50) intended to inhibit the damping means (40), the mobile interface being fitted with sliding shafts (53) inside guides (23) provided in the insert (20), the mobile interface (50) is also made from plastic material suitable for deformation, when necessary, during the recoil in order to keep the rifle balanced, guaranteeing in the meantime the coaxial nature of the shafts (53) sliding inside the guides (23).

13 Claims, 5 Drawing Sheets

RECOIL DAMPER SYSTEM

This invention relates to a recoil damper system.

This invention particularly relates to a recoil damper system for rifles designed for hunting or sports activities.

The recoil is a characteristic common to all firearm types, which leads to particularly significant effects in the case of longer guns.

This phenomenon, a characteristic application of the action/reaction principle, indicates the impulse that causes the gun to move back due to the impulse that the gun imparts to the bullet when firing it.

The shooter, and in particular the user of long guns, is often subjected to considerable impulsive forces in the rifle stock support zone.

It should be considered that the maximum acceleration peak may impart forces in the order of 300-400 kg, which are discharged onto the shooter's shoulder through a relatively small surface area, which is the end of the rifle stock.

These impulsive forces may injure the user and are definitively negative as regards preserving the aim, especially in the case of shots in rapid sequence. Various damper systems have been proposed in order to resolve the problems caused by long firearm recoil action.

One type of recoil damper system provides for the development of an elastic section in the rear part of the stock suitable for partially absorbing the recoil energy through deformation.

However, this system exhibits the problem of a distortion of the elastic section during recoil, which can easily cause sideways movement when the gun travels backwards.

The main consequence is that the movement of the gun during recoil does not follow the longitudinal axis of the same, but deviates, leading to the consequent loss of the line or fire and correct shouldering by the shooter.

A different solution to the recoil reduction problem was provided by the invention according to the British patent application GB 2371104.

The recoil damper system described in the aforementioned application provides for an end plate, to be secured to a rifle stock, comprising a hydraulic damper placed between two sliding guides in the form of bushes fitted with linear roller bearings.

An impulse transmission plate, bearing a couple of shafts designed to run through the guide bushes, works together with the plate to house a pair of springs suitable for elastically stiffening the system.

In fact, the hydraulic damper on its own would be too weak to sustain the recoil impulse.

These springs also serve the purpose of constituting the elastic pre-charge when shouldering the rifle.

In other words, when shouldering the rifle, the shooter exercises a traction on the transmission plate that comprises the springs.

According to GB2371104, the damper system exhibits some problems, linked to the correct movement of the rifle during the recoil phase.

The impulse transmission plate is made to be particularly stiff, it therefore tends to slide with a greater angle towards the support zone if this zone is not perfectly central.

This problem may lead to possible jamming of the shafts during their course through the bushes, despite the presence of the linear roller bearings.

However, the most serious problem that may arise is relative to erratic movement of the rifle during the recoil, due to the transmission plate which, being stiff, tends to increase any erratic movement.

In particular, having a single, substantially central damping element, the resistant forces applied by the shooter's shoulder, especially if distant from that centre, may lead to consistent moments that contribute to unbalancing the correct shooting posture.

Another problem, which may be found in the system according to the aforementioned British patent application, is relative to the presence of the springs that also comprise an elastic system when shouldering the rifle.

In other words, before firing, these springs compress on the basis of the traction exercised on the rifle by the shooter when he/she shoulders the same.

The shooter therefore finds him/herself having to keep the muscles involved contracted in order to prevent lessening the elastic grip.

Moreover, once again during this phase, the plate may tilt due to unbalanced traction, causing aim errors and contributing to the loss of the line of fire following the recoil.

As things currently stand, it is necessary to develop a recoil damper system that makes it possible to reduce the phenomenon and its effects without causing the shouldered rifle to become unbalanced.

Another object of this invention is to provide a recoil damper system that acts as a stiff whole before the rifle recoil.

The applicant found that it is possible to develop a recoil damper system suitable for transmitting a dampened and reduced recoil impulse to the user that does not cause the rifle to move erratically during the shot or at least that does not increase the effects of possible incorrect shouldering.

The applicant has developed a recoil damper system, for rifle stocks, suitable for transmitting a dampened and reduced recoil to the user, comprising an insert designed to be housed inside the stock of a rifle, and intended to house damping means, a mobile interface intended to inhibit the damping means, the mobile interface being fitted with sliding shafts inside guides provided in the insert, the mobile interface is also made from plastic material suitable for deformation, when necessary, during the recoil in order to keep the rifle balanced, guaranteeing in the meantime the coaxial nature of the shafts sliding inside the guides.

An aspect of this invention therefore regards a recoil damper system, for rifle stocks, suitable for transmitting a dampened and reduced recoil to the user, comprising an insert designed to be housed inside the stock of a rifle, and intended to house damping means, a mobile interface intended to inhibit the dampening means, the mobile interface being fitted with sliding shafts inside guides provided in the insert, characterized by the fact that the mobile interface is made from plastic material suitable for deformation, when necessary, during the recoil in order to keep the rifle balanced, guaranteeing in the meantime the coaxial nature of the shafts sliding inside the guides.

Another aspect of the invention regards the presence of a mechanical catch suitable for temporarily blocking the sliding of the shafts inside the guides, until the incipient recoil, in order to create a stiff whole that does not deform when shouldering the rifle and in order to develop a viscous/elastic damper system for better damping and dissipating the recoil energy.

These and other objects according to this invention are achieved by a recoil damper system according to that set out in claim 1.

Further features of this invention are the subject of the dependent claims.

The features and advantages of a recoil damper system according to this invention will be more evident in the following description, which is by way of example only and not restrictive, in reference to the enclosed diagrams in which.

Figure 1:
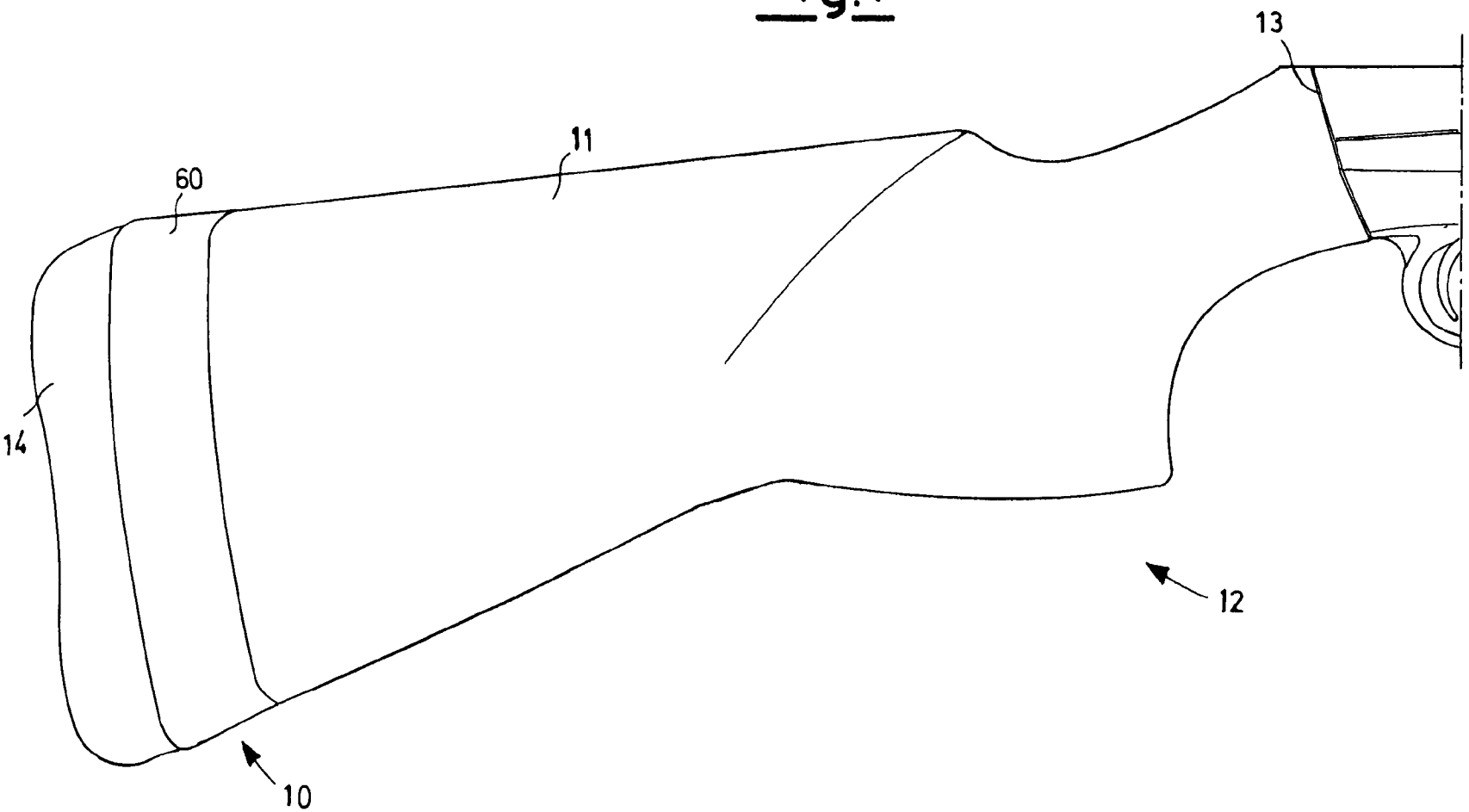
FIG. 1 is a lateral view of a rifle bearing the recoil damper system according to the invention.
Figure 2:
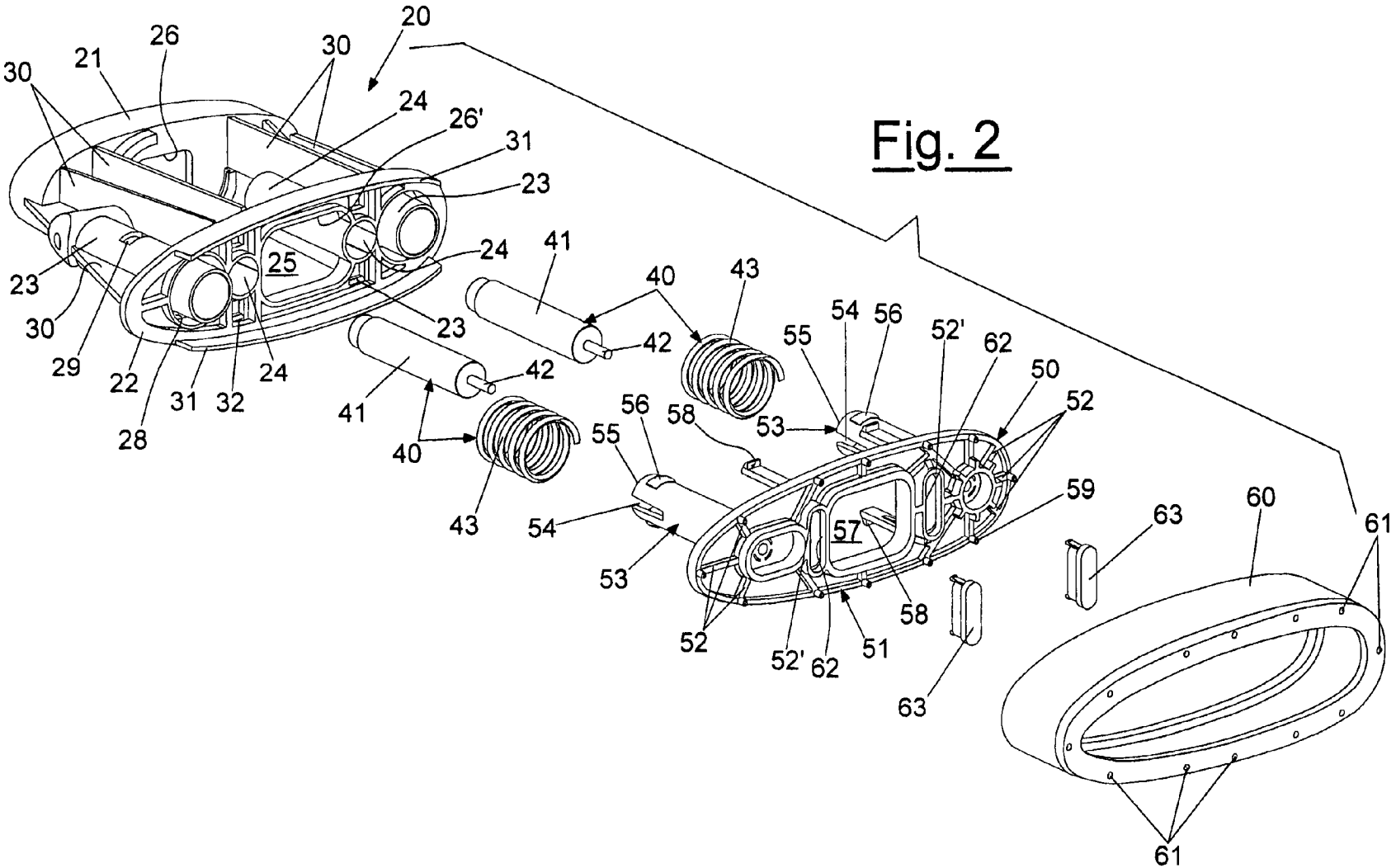
FIG. 2 is an exploded view of the system according to the invention.
Figure 3:
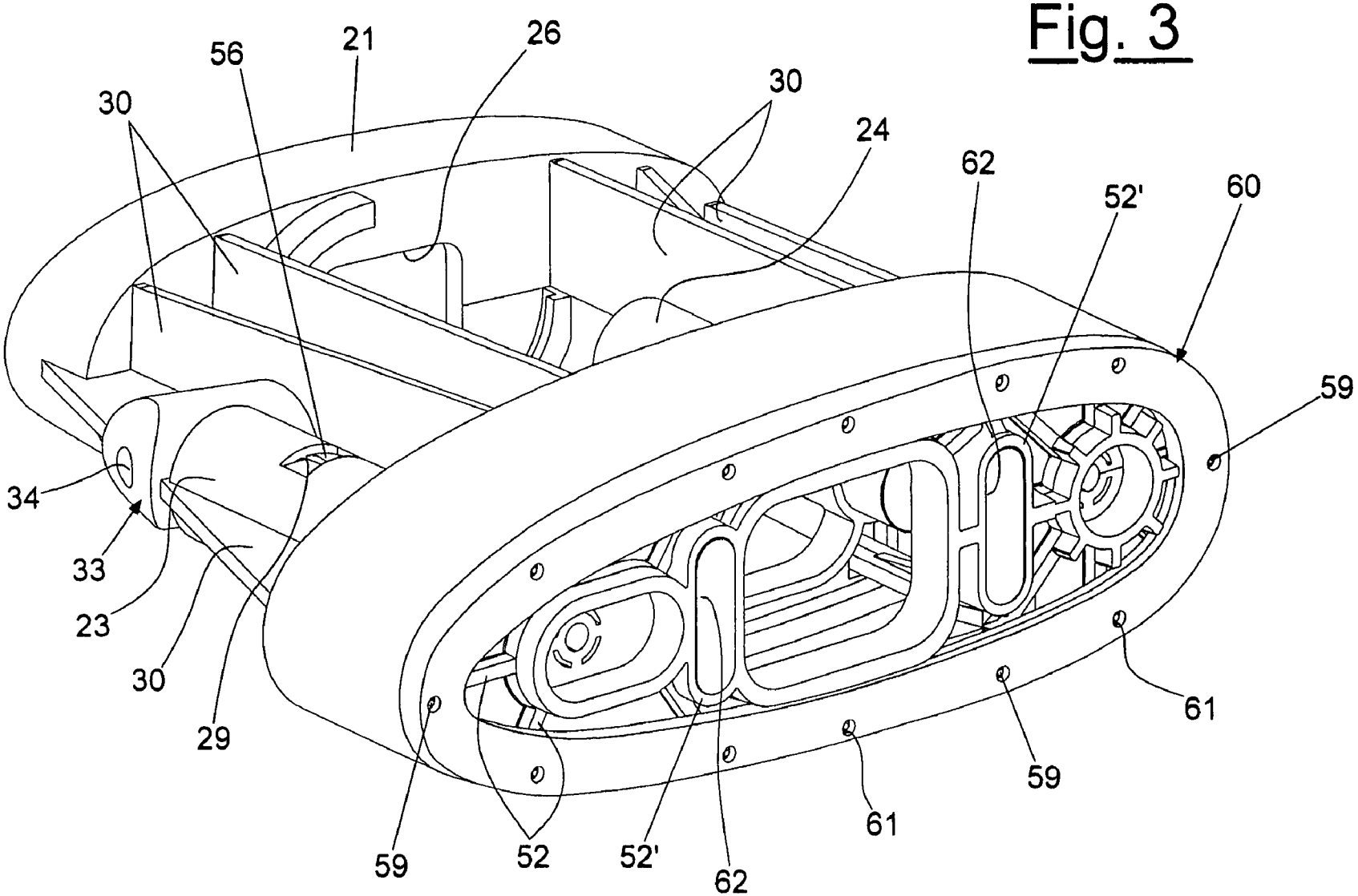
FIG. 3 is a front view of the system in FIG. 1 with the components assembled.
Figure 4:
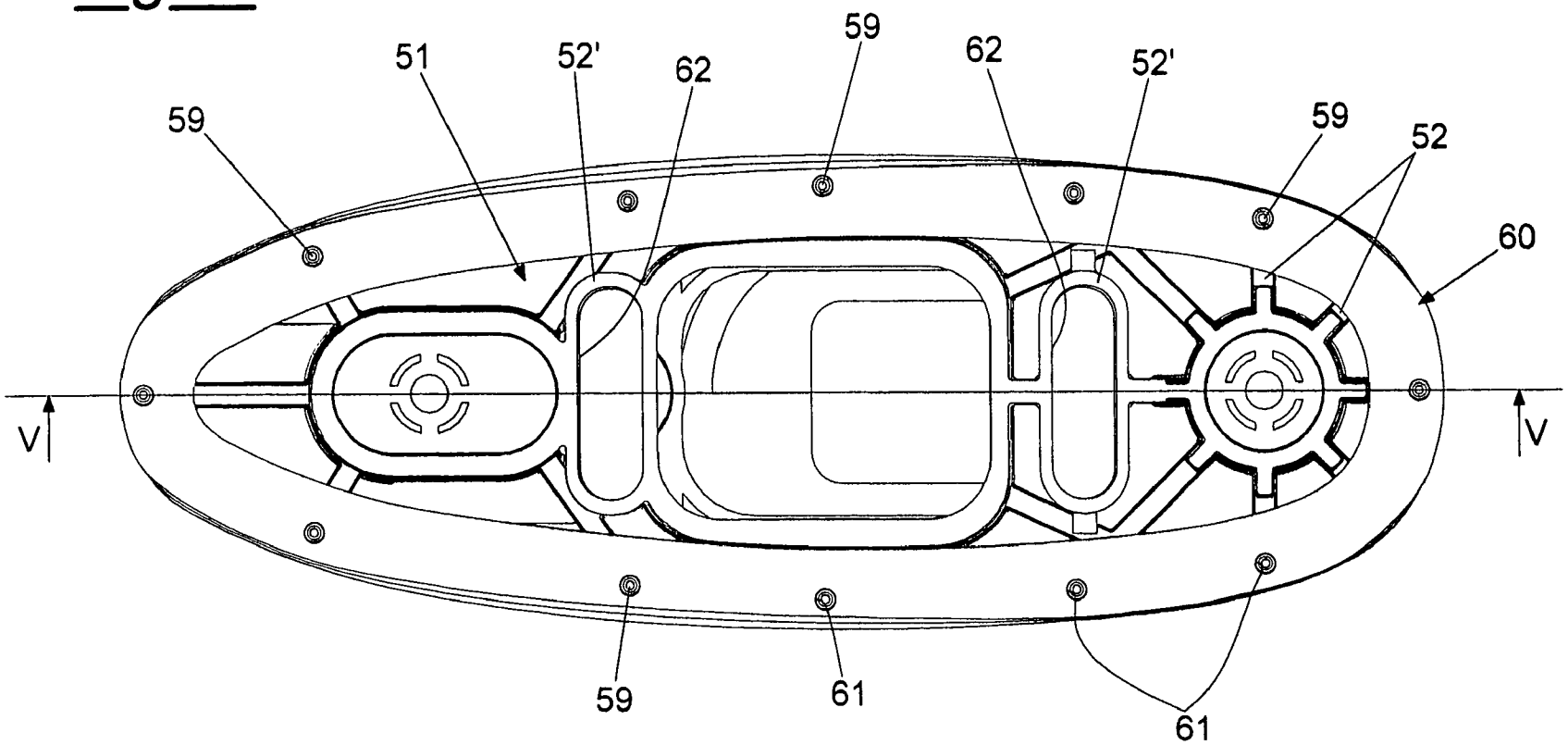
FIG. 4 is a view of the rear end of the system.
Figure 5:
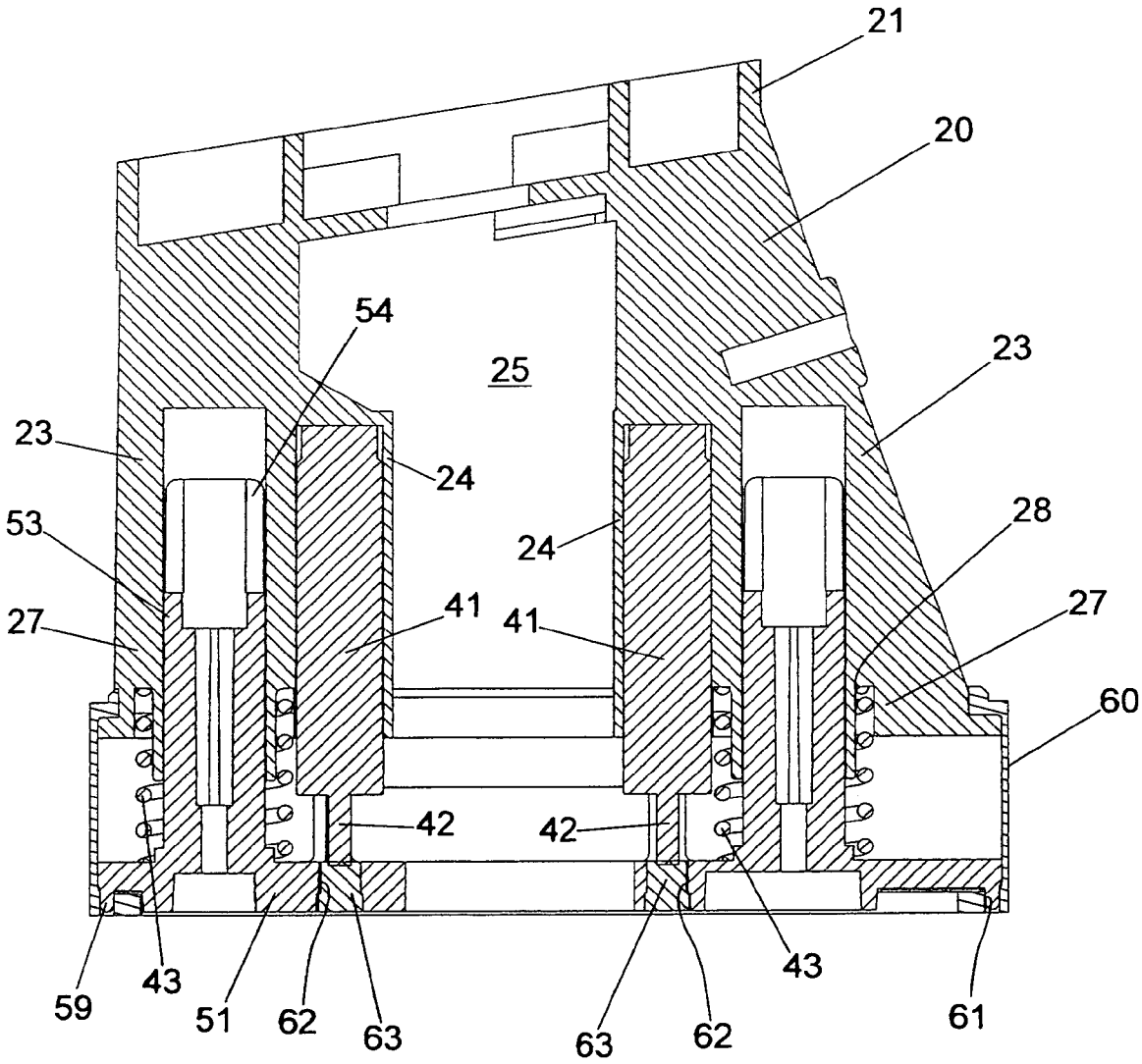
FIG. 5 is a section according to line V-V in FIG. 4.

In reference to the figures, a recoil damper system 10, suitable for transmitting a dampened and reduced recoil impulse to the user, comprises an insert 20 designed to be housed inside the stock 11 of a rifle 12, damping means 40 intended to be housed inside this insert, a mobile interface 50 intended to inhibit the damping means 40.

The insert 20 is configured in the form of a substantially squashed oval frame and tapered in the direction of the receiver, thereby following the internal profile of the stock.

The insert 20 is therefore provided with an internal base 21 and an external base 22 with reference to its placement inside the stock.

Between said bases 21, 22, a pair of guides 23 and a pair of housings 24 extend longitudinally, parallel to each other and to the longitudinal axis of the insert and are open at their ends in the proximity of the external base 22.

Guides 23 and housings 24 are intended to work together to support and/or house the damping means 40.

The preferred placement of the guides 23 is outside the sides of the housings 24, substantially in proximity to the ends of the external base compatibly with the insert structure and its tapered configuration.

Housings 24 are in the form of a hollow, preferably cylindrical body and are spaced apart so as to leave a central volume 25 of the insert free, provided with a first opening 26 in the external base 22 of the insert in order to allow access for securing and/or regulating the stock.

A second opening 26' corresponds to this opening in the internal base 21 for the passage of the aforementioned securing means.

The guides 23 are preferably cylindrical in form and engage with the external base 22, running through it for a stretch, and exhibit a section with an enlarged diameter 27 that creates an annular groove 28 towards the outside, surrounding the guide stretch engaged in the plate.

This section with an enlarged diameter 27 also serves the purpose of stiffening the guide to plate engagement zone.

Each guide 23 also exhibits at least one pair of facing slots 29 in its walls.

A plurality of bars 30 made in the form of reinforcement septums between the bases 21, 22, the guides 23 and the housings 24, create a longitudinal structure that reinforces the insert.

A fixture block 33 fitted with a hole 34 is also provided, preferably in a lower position transversally along one of the bars, in order to allow the insert to be fixed into place using suitable means (screws, pins or similar), once it has been inserted inside the rifle stock.

The external base 22 also exhibits some wall sections 31 that extend towards the exterior in order to act as anti-crushing protection for an elastic sheath 60 suitable for protecting the system.

The mobile interface 50 comprises a plate 51 reinforced by ribs 52 and is fitted with shafts 53 that extend perpendicularly to the plate in order to be inserted inside the guides 23, where they slide.

Each of said shafts 53 exhibits, at its end 55, a pair of opposing longitudinal notches 54 made starting from the end 55 of the shaft in order to give it a certain level of deformability.

In the proximity of the end 55 there are two opposing rounded raised sections 56 in the form of bosses, intended to engage the slots 29 of the housings 24 in order to comprise a temporary mechanical catch, suitable for developing a stiff whole before the recoil impulse.

Thanks to the presence of the longitudinal notches 54, the necessary deformability of the end section of the staff is guaranteed, which in its turn makes it possible for the raised sections to disengage from the slots, freeing the shaft during the recoil phase in order to allow it to slide.

To this regard, the shafts are made in order to exhibit limited friction so as not to jam when sliding inside the guides, facilitating this sliding motion.

According to the preferred design, both the insert 20, and the mobile interface 50 are each made from a moulded piece of suitable plastic material.

Naturally, the mechanical catch described is not the only item of its kind that can be made since, for this purpose, it is also possible to develop bosses or fins or teeth that are equally efficient.

The damping means 40 preferably comprise a pair of hydraulic dampers 41, each of which is to be inserted in one of the housings 24, fitted with a piston 42 suitable for receiving, through the butt 14, the recoil impulse, and a pair of springs 43, each surrounding one of the shafts 53 and supported inside the corresponding annular groove 28.

To this regard, the mobile interface 50 exhibits reinforcement ribs 52' and two oval holes 62, each suitable for housing a corresponding closing capsule 63 in correspondence to the contact zone with each piston, said closing capsules 63 make it possible to discharge the thrust of the hydraulic dampers on the butt instead of on the mobile interface, so that the latter do not damage the interface.

The mobile interface 50 is also made from plastic material suitable for deformation, when necessary, during the recoil in order to keep the rifle straight, guaranteeing the coaxial nature of the shafts 53 in the meantime when running inside the guides 23.

The plate exhibits a third opening 57 in the centre, in correspondence to the openings made in the insert.

From the plate 51, some restraint teeth 58 project towards the insert 20, suitable for engaging and blocking the mobile interface 50 on the insert 20, connecting to windows 32 made in the external base 22 of the latter.

Along the external surface of the mobile interface, axially in proximity to the edge, a plurality of couplings 59 project, suitable for receiving and engaging a section of edge correspondingly pierced with small holes 61 in the elastic sheath 60 suitable for protecting the system from the external environment, even during the recoil phase, connecting the plate and insert in the manner of a flexible hose.

On the mobile interface, a butt 14 in soft material is fixed in an external position, intended for contact with the shoulder of the shooter in order to guarantee comfort when shouldering the rifle.

The invention claimed is:

1. Recoil damper system (10) suitable for transmitting a dampened and reduced recoil to the user comprising an insert (20) designed to be housed inside a stock (11) of a rifle (12), said insert comprising:

damping means (40);

a mobile interface (50) intended to inhibit the damping means (40), said mobile interface (50) being constructed out of a plastic material that deforms when put under stress a plate (51) bearing sliding shafts (53) which extend perpendicularly to said plate (51), said sliding shafts (53) having a free end (55), and said sliding shafts (53) being inserted inside guides (23);

wherein each of said sliding shafts (53) exhibits at its free end (55), a pair of opposing longitudinal notches (54) located at the end (55) of the shaft, two opposing rounded raised sections (56) in the form of bosses, located at the end (55) of the shafts which are adapted to engage slots (29) of housings (24) in order to comprise a temporary mechanical catch, suitable for providing a stiff recoil damper system for the recoil impulse.

2. Recoil damper system according to claim 1, in which said mobile interface (50), and said sliding shafts (53), are constructed of suitably smooth materials so as to facilitate sliding into the guides (23).

3. Recoil damper system according to claim 1, in which said insert (20) is configured in a shape that allows said insert to be fitted into a receiving end of a rifle stock, said insert is further tapered in the direction of the receiver (13) of the rifle, thereby following the internal profile of the stock, said insert (20) being fitted with an internal base (21) and an external base (22) with reference to its placement inside the stock (11) of the rifle (12), between said internal and external bases (21, 22) a pair of guides (23) and a pair of housings (24) extend in a longitudinal direction, parallel to each other and to the longitudinal axis of the insert, said housings being open at their ends in the proximity to the external base (22).

4. Recoil damper system according to claim 3, in which said guides (23) and said housings (24) are designed to work together in order to support and/or house the damping means (40).

5. Recoil damper system according to claim 4, in which said guides (23) are positioned outside the sides of the housings (24), substantially close to the ends of the external base (22) and not extending beyond the dimensions of the insert (20).

6. Recoil damper system according to claim 5, in which said guides (23) are cylindrical in form and extend through the external base (22), passing through an enlarged diameter opening (27), thus creating annular grooves (28) located in said external base (22), each guide (23) also exhibiting at least a pair of facing slots (29), made in its walls.

7. Recoil damper system according to claim 6, in which said external base (22) also includes wall sections (31) that extend towards the exterior.

8. Recoil damper system according to claim 1, in which said damping means (40) comprise a pair of hydraulic dampers (41), each of which is to be inserted in one of the housings (24), each of said hydraulic dampers (41) being fitted with a piston (42) suitable for receiving, through a butt (14) of said rifle (12), the recoil impulse, and a pair of springs (43), each surrounding one of the sliding shafts (53) and said hydraulic dampers being supported inside a corresponding annular groove (28).

9. Recoil damper system according to claim 1, in which said mobile interface (50) exhibits reinforcement ribs (52') and two oval boles (62) suitable for housing a capsule (63) each, in correspondence to the contact zones with each piston.

10. Recoil damper system according to claim 1, in which said mobile interface (50) exhibits, along its external surface in proximity to the edge, a plurality of couplings (59) that project axially to said external surface, said plurality of couplings being suitable for receiving and engaging a section of edge correspondingly pierced with small holes (61) in an elastic sheath (60) which is suitable for protecting the system from the external environment.

11. Rifle stock prepared for housing a recoil damper system according to claim 1.

12. Rifle comprising a recoil damper system according to claim 1.

13. The recoil damper system according to claim 1, in which said plate (51) is reinforced by ribs (52).

* * * * *